US005503663A

United States Patent [19]

Tsou

[11] Patent Number: 5,503,663

[45] Date of Patent: Apr. 2, 1996

[54] SABLE COATING SOLUTIONS FOR COATING VALVE METAL ANODES

[75] Inventor: Yu-Min Tsou, Lake Jackson, Tex.

[73] Assignee: The Dow Chemical Company, Midland, Mich.

[21] Appl. No.: 346,820

[22] Filed: Nov. 30, 1994

[51] Int. Cl.[6] ..... C09D 5/24

[52] U.S. Cl. ..... 106/1.24; 106/1.28; 252/518; 252/520; 204/290 F

[58] Field of Search ..... 204/290 F, 290 R; 106/1.15, 1.24, 1.28; 252/518, 520

[56] References Cited

U.S. PATENT DOCUMENTS

| | | | |
|---|---|---|---|
| 3,632,498 | 1/1972 | Beer | 204/290 F |
| 3,711,385 | 1/1973 | Beer | 204/59 |
| 3,810,770 | 5/1974 | Bianchi et al. | 106/1.21 |
| 3,846,273 | 11/1974 | Bianchi et al. | 204/290 F |
| 4,070,504 | 1/1978 | Binachi et al. | 427/126 |
| 4,395,436 | 7/1983 | Bianchi et al. | 427/53.1 |
| 5,004,626 | 4/1991 | Dong et al. | 427/126.3 |
| 5,019,224 | 5/1991 | Denton et al. | 204/290 F |

*Primary Examiner*—Kathryn Gorgos

[57] ABSTRACT

Stable catalytic coating solutions are prepared using soluble compounds of at least two platinum group metals or at least one platinum group metal and at least one soluble compound of a valve metal. Valve metal anode bases coated with mixed oxide catalytic coating layers of a valve metal oxide and a platinum group metal oxide can be prepared with longer useful life by incorporation of a second platinum group metal. A mixed oxide coating of ruthenium, iridium, and titanium oxides is preferred for the coating layers in order to provide longer useful anode life.

8 Claims, 1 Drawing Sheet

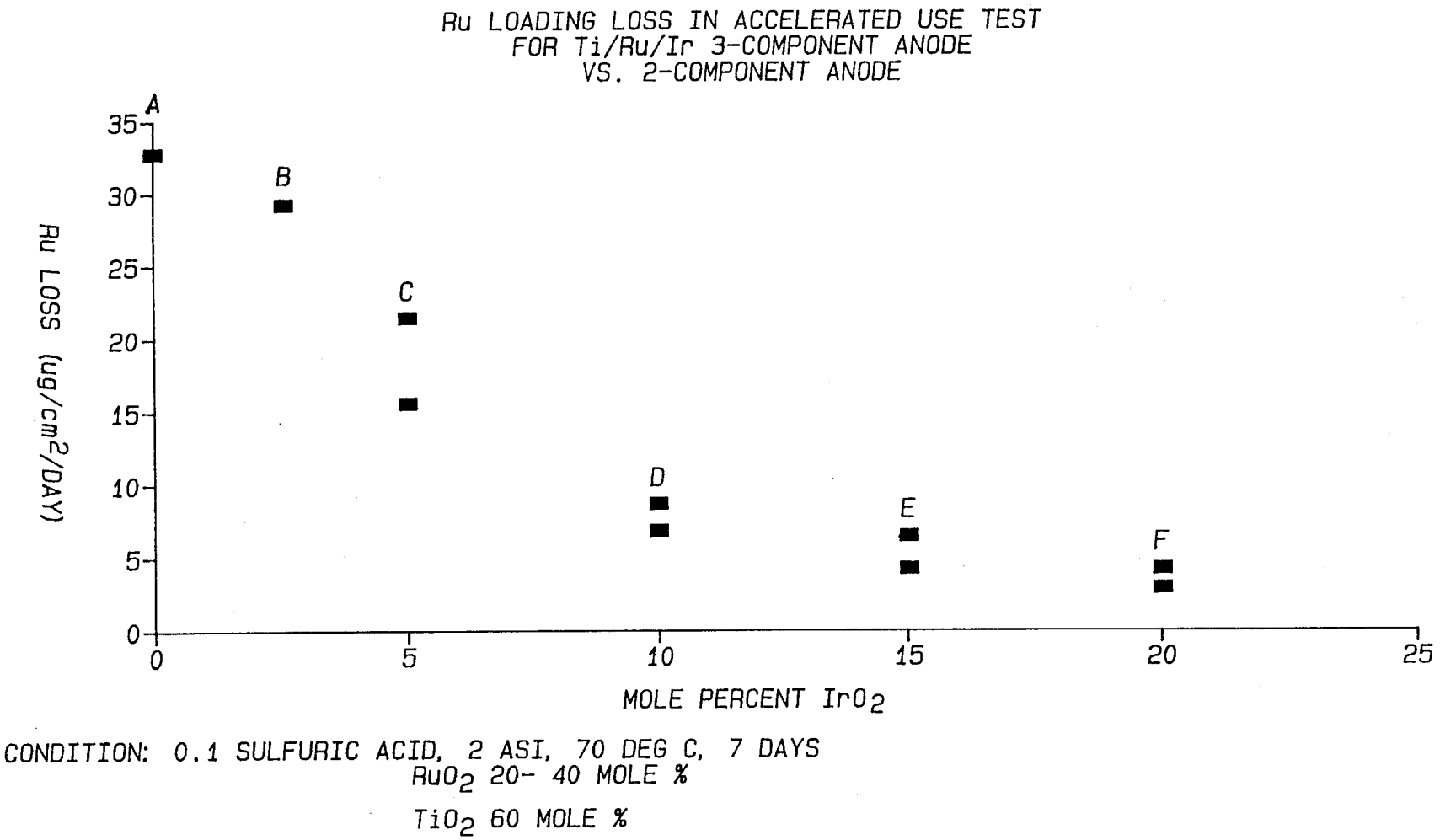
Ru LOADING LOSS IN ACCELERATED USE TEST
FOR Ti/Ru/Ir 3-COMPONENT ANODE
VS. 2-COMPONENT ANODE
Ru LOSS (ug/cm2/DAY)
35
30
25
20
15
10
5
0
A
B
C
D
E
F
0
5
10
15
20
25
MOLE PERCENT IrO2
CONDITION: 0.1 SULFURIC ACID, 2 ASI, 70 DEG C, 7 DAYS
RuO2 20- 40 MOLE %
TiO2 60 MOLE %

SABLE COATING SOLUTIONS FOR COATING VALVE METAL ANODES

BACKGROUND OF THE INVENTION

1. Field of the Invention

This invention relates to conductive, electrocatalytic coatings, such as electrocatalytic mixed oxide coatings and to stable, coating solutions for preparing mixed oxide coatings on metal substrates. The mixed oxide coatings on metal substrates or metal coated conductive substrates which are prepared utilizing the stable coating solutions of the invention are suitable as dimensionally stable anodes in electrolytic processes.

2. Description of Related Prior Art

The discovery of dimensionally stable anodes represents an important step in the progress of industrial electrolytic chemistry over the last thirty years. The advantages offered by dimensionally stable anodes have been exploited in various electrochemical processes including cathodic protection, electro-organic oxidations, and electrolysis of aqueous solutions. Because of the industrial importance of the electrolysis of aqueous solutions, the improvement disclosed herein relating to stable coating solutions useful in the preparation of dimensionally stable anodes will be described, particularly, with respect to the electrolysis of aqueous solutions, preferably, the electrolysis of alkali metal halides such as sodium chloride brine for the production of chlorine, caustic soda, and hydrogen.

The dimensionally stable anodes disclosed by Martinsons in U.S. Pat. No. 3,562,008 can comprise a valve metal base such as titanium having a coating of a thermally-decomposable titanium compound and a thermally-decomposable noble metal compound. The coating compounds are heated to decompose them to the oxides in order to prepare the mixed oxide coating on the valve metal base.

Beer in U.S. Pat. Nos. 3,711,385 and 3,632,498 discloses dimensionally stable anodes and liquid coating solutions for use in applying, respectively, soluble compounds of at least one platinum group metal or soluble metal compounds of at least one platinum group metal and a film-forming metal to a valve metal base in the preparation of an electrode for use in an electrolytic process. Beer et al. in U.S. Pat. No. 4,797,182 have sought to improve the lifetime of dimensionally stable electrodes having a film-forming metal base by the use of multiple, separate component layers of platinum metal and an oxide of iridium, rhodium, palladium, or ruthenium.

Bianchi et al. in U.S. Pat. No. 3,846,273 disclose doping a valve metal oxide base to provide electrodes having semi-conductive surfaces. These surfaces are produced on a valve metal base such as titanium or tantalum by applying a soluble mixture of metal compounds in several separate layers and heating the coating on the valve metal base between the application of each layer. Methods of producing the electrodes of '273 are disclosed in U.S. Pat. No. 4,070,504. Bianchi et al. in U.S. Pat. No. 4,395,436 disclose a process for preparing a dimensionally stable electrode by the application on a valve metal substrate of a metal compound capable of decomposing under heat. The coating is thereafter subjected to localized high intensity heat sufficient to decompose the compound while maintaining a portion of the substrate at a lower temperature.

The various coating compositions disclosed in the above prior art references, fail to address the problem of the long term stability of the coating solutions used to apply these coatings to a valve metal substrate. The stability of the coating solution for preparing the electrode is of less importance where the components of the coating solution are merely soluble ruthenium and titanium compounds. Where it is found necessary to use a soluble iridium compound in addition to ruthenium and titanium compounds, the substantially greater cost of the iridium compounds mandates that the coating solution have long term stability. It has been found to be desirable to have coatings of mixed oxides, for instance, iridium oxide in admixture with ruthenium oxide and titanium oxide in the catalytic coating in order to provide an anode having a longer lifetime than has been demonstrated for the prior art mixed oxide ruthenium oxide and titanium oxide catalytic coating on valve metals.

In general, an early failure of such electrodes is attributed to two major factors, namely, loss of the active coating by dissolution, and/or, passivation by the formation of a highly resistive $TiO_2$ or $Ta_2O_5$ layer between the substrate and the oxide coating. Sometimes these two factors occur simultaneously and the electrode at the end of its lifetime may show some active material left in the coating or may show a substantial coating amount remaining but passivation has occurred so as to require that the anode be operated at increased potential. In accordance with the teaching of U.S. Pat. No. 4,797,182, a common solution to the problem of loss of the active component in the coating and subsequent passivation of the substrate is the use of thicker coatings of the active component. For instance, 10 to 20 layers of the active coating provide an increased lifetime in electrodes utilizing the same coating composition. It is obvious that an increase in the coating thickness results in a significantly increased cost for the electrode.

Dimensionally stable anodes based upon a catalytic coating on a valve metal substrate have been used in diaphragm cells, mercury cells, and in membrane cells. A significant difference in anode coating life results from differences between the operation of these types of cells. For instance, a different current density characterizes each of these cells. Diaphragm cells are designed to operate at current densities of about 0.4–1.0 ASI while membrane cells typically operate at 2.0–3.0 ASI. Mercury cells typically operate at about 6.5 ASI. Other factors which influence anode coating life include the coating formulation and the operating parameters including brine purity, and exposure to alkaline operating conditions. In diaphragm cells, the diaphragm typically is in contact with the anode, and where the diaphragm swells excessively, alkaline exposure of the anode occurs. Still another factor affecting coating life is the production of oxygen under acidic conditions. Membrane and diaphragm cells always produce a small amount of oxygen at the anode on the order of 0.5–3.0 volume percent as a result of inefficiency reactions. In membrane cells which operate at a substantially higher current density than diaphragm cells, the amount of oxygen produced at the anode per unit time is significantly higher than for diaphragm cells. In addition, damage to the cell membrane often exposes the anode to a highly alkaline environment which causes rapid degradation of the anode.

In the dimensionally stable anodes for chlor-alkali electrolytic cells as disclosed in the Beer patents, referred to above, which contain a catalytic coating on a titanium base consisting of a mixture of ruthenium and titanium oxides, one cause of anode degradation is the formation of $RuO_4$ during oxygen evolution at the anode. While oxygen evolution is only about 1–3 percent of the chlorine evolution at the anode during normal cell operation, the long term effect of the formation of $RuO_4$ is significant. Accordingly, it would be desirable to develop an anode having a longer lifetime in which oxygen evolution at the anode is suppressed by modifying the chemical composition of the catalytic anode coating.

SUMMARY OF THE INVENTION

Stable anode coating solutions for valve metal substrates or valve metal coated substrates have been developed. Catalytic coatings on valve metal substrates or on the valve metal of valve metal coated substrates using the stable coating solutions of the invention provide a longer anode service life, especially, when used in electrolytic cells utilizing permselective membranes. The improved service life of one embodiment of the inventive dimensionally stable anodes of the invention is the result of coating a valve metal or alloy thereof, base anode or a valve metal or alloy thereof, coated, conductive substrate with a mixture of two soluble platinum group metal compounds. A soluble ruthenium compound is used in admixture with another soluble platinum group metal compound selected from the group consisting of iridium, platinum, palladium, rhodium, and osmium, preferably an iridium compound. In addition, soluble valve metal compounds, preferably, titanium or tantalum compounds are included as coating components to make the novel coating composition of the invention.

Because of the substantially higher cost of soluble iridium compounds in comparison with soluble ruthenium and titanium compounds and the discovery of the instability of coating solutions containing these three components, research in order to overcome such instability has been conducted in order to make the novel anode coating commercially useful. It has been found that the catalytic anode coatings of the invention have adequate coating solution stability when applied from an anhydrous mixture of at least one anhydrous, lower alkyl alcohol and at least one anhydrous volatile acid. Generally, at least one anhydrous lower alcohol and at least one anhydrous volatile acid are used as solvents. Preferably, the lower alkyl alcohol is selected from the group consisting of methanol, ethanol, 1-propanol, 2-propanol, and butanol, most preferably, 2-propanol and, preferably, the volatile acid is selected from the group consisting of hydrochloric acid, hydrobromic acid, acetic acid, and formic acid, most preferably, hydrochloric acid.

In the preparation of one embodiment of the dimensionally stable anode coating of the invention, a thermally-decomposable liquid coating solution is applied to a valve metal base or the valve metal surface of a valve metal surfaced conductive substrate. Useful valve metals are aluminum, zirconium, bismuth, tungsten, niobium, titanium, and tantalum or alloys thereof. Said coating solution comprises: (1) at least two soluble, platinum group metal compounds, one of which is a ruthenium compound; (2) preferably, a soluble compound of titanium or tantalum, most preferably, titanium; (3) at least one anhydrous volatile acid; and (4) at least one anhydrous, lower alkyl alcohol. The valve metal base is, preferably, titanium. The coating is dried and heated to convert the metal compounds in the coating composition to their respective oxides prior to the application of optional, successive coating layers. The coating solutions of the invention are characterized as anhydrous having substantially less water content than can be obtained by the prior art use of 37 percent aqueous hydrochloric acid as a component of an anode coating solution.

In another embodiment of the anode liquid coating solution of the invention, said coating solution comprises: (1) a soluble platinum group metal compound, most preferably, an iridium compound; (2) a soluble valve metal compound, preferably, a soluble compound of titanium or tantalum; (3) at least one anhydrous lower alkyl alcohol; and (4) at least one anhydrous volatile acid.

BRIEF DESCRIPTION OF THE FIGURE

The Figure shows the amount of loss of the ruthenium component from a 3 component ($TiO_2/RuO_2/IrO_2$) anode coating on a titanium base when exposed to accelerated use testing in 0.1N sulfuric acid for 7 days at 70° C., and 2 ASI. Loss of the ruthenium component over time is reduced as the mole percent of iridium contained in the coating is increased. The mole percent of titanium in the coating is held constant at 60 mole percent. The loss of ruthenium from a prior art 2 component ($TiO_2/RuO_2$) anode coating on a titanium base is shown at A. The loss of ruthenium from the 3 component embodiment of the inventive anode is shown at B–F.

DESCRIPTION OF THE PREFERRED EMBODIMENTS

It has now been found in accordance with one embodiment of the invention that when a second platinum group metal oxide is incorporated in a ruthenium oxide and valve metal oxide mixed oxide catalytic coating on a valve metal substrate or on the valve metal surface of a valve metal surfaced substrate that the lifetime of the dimensionally stable electrode thus produced is significantly increased. Similar results are obtained with another embodiment of the mixed oxide coating of the invention comprising a platinum group metal oxide, most preferably, iridium oxide and a valve metal oxide.

The corrosion of a ruthenium-titanium anode catalytic coating on a valve metal is considered to be the result of dissolution of $RuO_2$ as a result of the formation of ruthenium oxide ($RuO_4$) during oxygen evolution at the dimensionally stable anode during the operation of the electrolytic cell, as disclosed in Trasatti et al., *Electrodes of Conductive Metallic Oxides*, Elsevier, Chapter 7, (1980), Kotz et al., *Electroanalytic Chemistry,* 172 and 211 (1984), Kotz et al., *Journal of the Electrochemical Society,* 130, 825 (1983), and Burke et al., *J.C.S. Faraday I,* 68 and 839 (1972). Dissolution of $RuO_2$ is uneven. This increases the likelihood of penetration of the electrolyte through the coating to the coating interface so as to promote anode passivation. It is known that in the electrolysis of brine solutions in a chlor-alkali electrolytic cell, that 1–3 percent of oxygen is produced at the anode. The mechanism of oxygen evolution on an electrode having a surface coating of $RuO_2$ is believed to start with the oxidation of $RuO_2$ to $RuO_3$. Oxygen is released from $RuO_3$ to yield $RuO_2$. However, a fraction of the $RuO_3$ can be oxidized to yield $RuO_4$. The slow deterioration of the anode coating by the surface oxidation of $RuO_2$ to $RuO_3$ with the release of oxygen are the preliminary steps preceding the oxidation of ruthenium to $RuO_4$. While a surface coating containing $RuO_3$ is substantially stable, the $RuO_4$ form of the oxide can be removed from the surface readily. Reduced dissolution of $RuO_2$ can be achieved by including another platinum group metal in admixture with ruthenium oxide in the catalytic coating.

In accordance with one embodiment of the composition and process of this invention, it has been found that useful valve metal base or valve metal coated substrate anodes of the invention comprise at least one mixed oxide layer containing generally, about 10 to about 40 mole percent of ruthenium, calculated as the oxide, about 30 to about 80 mole percent tantalum or titanium, calculated as the oxide, and another platinum group metal, calculated as the oxide, in the amount of about 3 to about 30 mole percent. Preferably, about 3 to about 20 mole percent of the other platinum group metal component, calculated as the oxide, is used in combination with about 20 to about 40 mole percent of the ruthenium component, calculated as the oxide, and about 40 to about 80 mole percent of the tantalum or titanium component, calculated as the oxide. Most preferably, the mixed oxide layer contains about 50 to about 70 mole percent tantalum or titanium, about 20 to about 30 mole percent of ruthenium, and about 5 to about 15 mole percent of another platinum group metal, all calculated as the oxides. The other platinum group metal is chosen from the platinum group metals other than ruthenium and is, preferably, iridium and platinum and, most preferably, iridium. The mixed oxide coating on the valve metal anode base or on the valve metal surface of a valve metal surfaced substrate is effective in increasing the lifetime of the anode by retarding the corrosion of $RuO_2$. This is because the preferred iridium oxide and ruthenium oxide components are iso-structural, that is, they can exist simultaneously in a crystalline structure. It is known that $RuO_2$ and $IrO_2$ exhibit electronic interaction through oxygen bridges. This interaction causes an increase in the oxidation potential for the conversion of $RuO_3$ to $RuO_4$ with the release of oxygen. Accordingly, the corrosion rate which is a function of the proportion of $RuO_3$ which is converted to $RuO_4$ is retarded. It is believed that the major route for the oxidation of the $RuO_2$ to $RuO_3$ and, ultimately, the conversion to $RuO_4$ is as follows:

$$RuO_2+H_2O \rightarrow RuO_3+2H^++2e^- \quad (1)$$

$$RuO_3 \rightarrow RuO_2+O \quad (2)$$

$$RuO_3+H_2O \rightarrow RuO_4+2H^++2e^- \quad (3)$$

It is considered that platinum group metal oxides other than the preferred iridium oxide may be equally effective in retarding the corrosion rate of catalytic coatings containing valve metal oxides in admixture with ruthenium oxide in view of the fact that any other platinum group metal oxide that is iso-structural, that is, platinum group metal oxides that form solid solutions with ruthenium oxide will be equally effective in reducing the corrosion rate of ruthenium oxide. Accordingly, it is intended to cover in the attached claims all such platinum group oxides as alternatives to iridium oxide as components of a three component anode coating containing ruthenium and titanium oxides on valve metal bases, preferably, titanium or tantalum base anodes or on a valve metal coating on substrates coated with valve metals. Since the preferred iridium component of the inventive three component anode coating is more expensive by a factor of more than four times the cost of the ruthenium component of the coating, further evaluation of the three component valve metal base anode coating was accomplished utilizing a most preferred coating component ratio of titanium oxide, ruthenium oxide, and iridium oxide of 60/30/10 calculated as molar percentages of the respective oxides.

In addition to evaluation of the loss of ruthenium under the accelerated use test conditions described below in Examples 1–6 and in the Figure, the chlorine evolution potentials in saturated brine at 90° C. of the same valve metal coated anodes were examined subsequent to the one week accelerated test procedure. A prior art coated titanium base anode with a coating having the composition of 60 percent by weight titanium oxide and 40 percent by weight ruthenium oxide (Control Example 1 ) initially shows a potential of about 1.13 to about 1.14 volts vs. a standard calomel reference electrode. A constant IR drop from the electrical lead to the electrode is included in the measured potentials. After one week of exposure to the accelerated test method, the chlorine potential of the prior art anode increases to about 1.15 to 1.16 volts vs. a standard calomel reference electrode. The addition of from 3 to 20 percent by weight of iridium oxide and the concurrent reduction of the ruthenium oxide percent by weight from 40 percent to 20 to 37 percent by weight in the 3 component inventive anode of Examples 2–6 results in either a substantially unchanged chlorine evolution potential or, a 10–20 millivolt reduction in potential.

In U.S. Pat. No. 3,846,273, cited above, coating solution examples are disclosed which contain a valve metal compound such as $TiCl_3$ or $TaCl_5$ and one or more precious metal compounds. The examples show the use of ruthenium and iridium or ruthenium and gold in combination with either titanium or tantalum compounds to prepare mixed oxide coatings for metal halide electrolysis. Where a ruthenium/iridium/titanium coating mixture was used, a high concentration of aqueous hydrochloric acid together with 30 percent hydrogen peroxide and isopropyl alcohol (or formamide)was used as the solvent. It has been found that this solvent system is stable only for short term use. The use of aqueous hydrochloric acid as a component of coating solutions of the prior art causes the precipitation of most soluble titanium compounds as a species of titanium polymer. The peroxo species generated by the reaction of $TiCl_3$ with 30 percent hydrogen peroxide is only stable for a short period of time. In addition, the stability problems caused in these coating solutions by the hydrolysis of $RuCl_3$ and the formation of cationic species is not addressed in the '273 patent. Use of the solvents disclosed for the coating solution of the invention comprising at least one anhydrous, lower alkyl alcohol and at least one anhydrous volatile acid, such as hydrochloric acid overcomes the instability caused by the hydrolysis of $RuCl_3$ and the formation of cationic species in a coating solution containing a mixture of ruthenium, iridium, and titanium compounds. This solvent mixture is also useful to provide a stable coating solution containing tantalum and iridium or ruthenium compounds. An additional advantage obtained by using a solvent mixture comprising an anhydrous lower alkyl alcohol and an anhydrous volatile acid is the faster evaporation rate of this mixture in comparison with, for instance, a solvent prepared by mixing an organic solvent with 37 percent aqueous hydrochloric acid.

The anodes are, generally, prepared by the application to a vane metal or alloy thereof base or a valve metal or alloy thereof surface of a valve metal or ahoy thereof surfaced substrate of at least one layer and, optionally up to four or more coating layers followed by drying and baking after the application of each coating. Each coating is applied by immersion of the valve metal base or valve metal surface. Other suitable methods such as spraying or painting can be used in the coating solution. After the application of each coating, the excess coating is allowed to drain off and the assembly is air dried. Thereafter, the assembly is baked in an oven and held at a temperature of about 450° C.–500° C. for a period of about 20 minutes. After the application of the final coating solution to the anode assembly, the coated electrode is baked for about 1–2 hours at 450° C.–500° C. to convert the soluble metal compounds to their respective oxides. The soluble compounds of the anhydrous coating solution in one embodiment of the anode of the invention comprise at least two platinum group metal compounds, one of which is a ruthenium compound, and at least one valve metal soluble compound.

In another embodiment of the anode of the invention, the coating solution comprises a soluble compound of a platinum group metal, most preferably, ruthenium or iridium and a soluble compound of a valve metal. Representative useful platinum group metals and useful valve metals or alloys thereof for use as an anode base or as a component of a soluble compound are as disclosed above. In accordance with this embodiment of the invention, useful valve metal base or valve metal coated substrate anodes of the invention comprise at least one mixed oxide layer containing, generally, about 60 to about 90 mole percent of a platinum group metal, most preferably, ruthenium or iridium as iridium or ruthenium oxide and about 10 to about 40 mole percent valve metal oxide. Preferably, the oxide layer contains about 70 to about 80 mole percent iridium as iridium oxide and, about 20 to about 30 mole percent valve metal oxide, preferably titanium or tantalum oxide and, most preferably, about 70 to about 75 mole percent iridium oxide and about 25 to about 30 mole percent tantalum oxide. A typical coating weight on the coated anode is about 400 to about 900 micrograms per square centimeter. Representative useful anhydrous, volatile acids and anhydrous, lower, alkyl alcohols as coating solvents are as disclosed above. Preferred anhydrous solvents are anhydrous 2-propanol and anhydrous hydrochloric acid. Preferred coating solutions contain as solvents the preferred concentrated hydrochloric acid with a major component of the preferred 2-propanol. The proportion of the preferred concentrated hydrochloric acid in the coating solution can be from about 0.5 percent by weight to about 5 percent by weight with the balance lower alkyl alcohol.

The anode base can be any valve metal or valve metal surfaced substrate. Useful valve metals are titanium, tantalum, zirconium, niobium, tungsten, and silicon and alloys containing one or more of these metals. Titanium is preferred for reasons of its comparatively low cost. Valve metals, also known as film-forming metals are metals or alloys thereof which have the property, when connected as an anode in the electrolyte in which the coated anode is expected to operate, of rapidly forming a passivating oxide film which protects the underlying metal from corrosion by electrolyte. Typical useful valve metals and alloys are metals such as titanium and tantalum and alloys such as titanium-nickel, titanium-cobalt, titanium-iron, and titanium-copper. Rods, tubes, woven wires, or knitted wires, and expanded meshes of titanium or other valve metals can be used as the electrode base material. Titanium or other valve metal clad on a conducting metal core or substrate can also be used. It is also possible to treat porous sintered titanium with coating solutions prepared in accordance with the inventive coating solutions of the invention. Generally, the valve metal surface electrode will be etched or sandblasted prior to the application of the electrocatalyst coating. It is also possible to simply clean the valve metal surface by known methods other than sandblasting or etching prior to the application of the electrocatalyst coatings.

Typically, the catalytic vane metal base or vane metal coated substrate electrode of the invention has a mixed oxide coating of about 6 to about 8 grams per square meter of vane metal surface and is expected to be capable of operating over a lifetime of more than 40,000–60,000 hours at current densities of about 2 to 3 ASI (amperes per square inch of projected anode area).

Electrodes prepared by coating a vane metal with various coating layers of platinum metal and a platinum group metal oxide are known from U.S. Pat. No. 4,797,182. Separate coating layers are disclosed in '182 of iridium oxide, rhodium oxide and palladium oxide. Codeposition from stable coating solutions of soluble titanium and iridium compounds on a vane metal base is not known. While electrodes having an electrically conductive base and coatings of mixed oxides of a vane metal and a platinum group metal are known from U.S. Pat. No. 3,632,498, codeposition of soluble ruthenium, titanium, and another platinum group metal on a valve metal base from a stable coating solution is not known.

Where not otherwise specified in this Specification and Claims, temperature is in degrees centigrade and parts, percentages, and proportions are by weight.

The loss of performance of valve metal base anodes coated with a mixture of platinum group metal oxides and titanium oxide is too slow during normal operation for rapid evaluation of performance differences attributed to loss of the valve metal catalytic coating during operation of the electrolytic cell. Rapid evaluation of small increases in potential which occur over time during normal operation of an electrolytic cell containing such anodes is also impossible. Accordingly, an accelerated test was used to evaluate the embodiments of the anode of the invention in comparison with prior art electrodes. This test method involves subjecting the electrode to a 0.1N solution of sulfuric acid at a potential of 2 ASI at 70° C. for a period of one week. The Figure shows at B–F the results of an accelerated use testing evaluation of one embodiment of a three component anode of the invention prepared from a coating mixture of soluble compounds of titanium, ruthenium, and iridium which are converted to the respective oxides after deposition of the coating on the titanium base. Element A is a two component control anode. In Examples 1–6, the proportion of titanium oxide is kept constant at 60 mole percent and the ruthenium oxide content varies from 40 mole percent in Control—Example 1 to 20 mole percent in inventive Example 6. The balance of the oxide mixture in Examples 2–6 is iridium oxide in the proportion of about 3 to 20 mole percent. The Figure shows that the ruthenium loss in micrograms per square centimeter on a daily basis ranges from almost 33 micrograms per square centimeter per day for the two component prior art mixture, (Control) labeled A, containing no iridium oxide to about 3.4 to about 4.6 micrograms per square centimeter per day for the three component mixture, labeled F, containing 20 mole percent of iridium oxide. Other representative proportions of iridium oxide in the inventive electrode are shown in the Figure as B–E.

In Examples 1–6, the performance of titanium base anodes coated with mixed oxide catalytic coatings were evaluated in an accelerated test for erosion of the catalytic coating. The following table sets forth the components of the catalytic coatings and the results obtained in the accelerated erosion test.

TABLE

EXAMPLES 1–6

| Anode Coating Components (mole %) | Example 1 (Control) | Example 2 | Example 3 | Example 4 | Example 5 | Example 6 |
|---|---|---|---|---|---|---|
| $TiO_2$ | 60 | 60 | 60 | 60 | 60 | 60 |
| $RuO_2$ | 40 | 37 | 35 | 30 | 25 | 20 |
| $IrO_2$ | — | 3 | 5 | 10 | 15 | 20 |
| Loss of Ru micrograms per sq cm per day | 33.4 | 29.3 | 22.2, 15.8 | 7.2, 8.5 | 4.1, 6.2. | 3.4, 4.6 |
| Reference in FIG. | A | B | C | D | E | F |

In the following Examples, a prior art unstable coating solution utilizing aqueous hydrochloric acid as a component of the solvent system for a titanium oxide/ruthenium oxide/iridium oxide three component anode coating mixture of the invention is set forth in Control Example 7. In control Examples 8 and 9, the effect is shown of the concentration of aqueous hydrochloric acid in the coating solution on the stability of the coating solution. In inventive Examples 10–12, stable coating solutions are disclosed in accordance with the teaching of this invention. It is noted that titanium compounds such as titanium isopropoxide hydrolyze to form precipitates in solutions containing water. The higher the water content of the solution, the faster the formation of the hydrolyzed precipitate. The precipitate formed is believed to be a polymer with repeating units of ($Ti_3O_4$ $(Opr)_4$). The hydrolysis reaction proceeds with the replacement of the isopropoxyl ligand with an hydroxyl group. More isopropoxyl ligands are eliminated as more titanium-oxygen-titanium bridging groups are formed.

EXAMPLE 7

Control, forming no part of this invention

The following solution was prepared.

| COMPONENT | GRAMS |
|---|---|
| $RuCl_3 \cdot xH_2O$ | 1.74 |
| $IrCl_3 \cdot yH_2O$ | 0.86 |
| Ti(iso-propoxide)$_4$ | 3.42 |
| 2-propanol | 100.00 |
| HCl, 37% aqueous | 1.2–2.8 |

A short time after preparation of this solution, a very fine, black, colloidal precipitate was observed together with a titanium polymer precipitate. The titanium polymer precipitate was removed by a coarse frit. The fine, black, colloidal precipitate from this coating solution was collected utilizing a centrifuge. Centrifuging at about 6000 rpm results in sedimentation. Washing the solids obtained with 2-propanol and again centrifuging followed by repetition of this procedure for a total of three times resulted in a precipitate which was, thereafter, washed with acetone three times followed by drying in air.

Upon analysis of the dried samples by energy dispersive x-ray (EDX) spectroscopy for the ratio of ruthenium and iridium, it was found that the precipitate formed from the three component solution contains comparable amounts of ruthenium and iridium. Accordingly, it is assumed that the precipitate may be a salt of oppositely charged iridium and ruthenium complexes. The composition of the precipitate containing comparable amounts of ruthenium and iridium was not analyzed for composition, but it is considered that the components consist of a negative iridium complex and a positive ruthenium complex rather than a positive iridium complex and a negative ruthenium complex. The latter would be quite slow in formation because hydrolysis of the iridium complex would be extremely slow at room temperature. Accordingly, in accordance with the invention, it was found that adjustment of the concentration of the hydrochloric acid can be made to prevent the formation of the cationic ruthenium complexes. Coating solution stability was not obtained until the substitution of anhydrous hydrochloric acid was made for 37 percent aqueous hydrochloric acid.

EXAMPLES 8 & 9

Controls, forming no part of this invention

Two coating solutions were prepared using 37 percent aqueous hydrochloric acid to determine the effect of the concentration of hydrochloric acid on coating stability. Both solutions contained about 1.73 percent by weight of $RuCl_3 \cdot H_2O$, 1.2 percent by weight of $H_2IrCl_6 \cdot 6H_2O$, and 4.13 percent by weight Ti(isopropoxide). The mole ratio of metals in the coating solution was 6 moles titanium, 3 moles ruthenium, and 1 mole of iridium. The weight percent of hydrochloric acid in Example 8 was 1.16 percent by weight (about 0.25N). The weight percent of hydrochloric acid in Example 9 was 2.32 percent (about 0.5N). Each of the solutions prepared in Control Examples 8 and 9 were divided into two portions. One portion was stored while the other portion was used to coat a fine mesh titanium anode leaving half of the solution subsequent to coating the titanium mesh. The solution of Example 8, containing about 0.25N hydrochloric acid became blue-black in color after aging seven days whether or not the solution was used to coat a titanium mesh or merely stored. This solution originally had a brown-red color. The solution used to coat the fine mesh titanium base showed more severe colloid development. After three to four weeks, both solutions had deteriorated as evidenced by the formation of a black precipitate at the bottom of the solution.

With respect to the solution prepared in Control Example 9 having 0.5 N hydrochloric acid, after ten days from the date of preparation of the solutions, both the stored solution and the solution utilized to coat the fine mesh titanium base remained transparent with a brown-red tint to the solutions. After four weeks from the date of preparation, the solution used to coat the fine mesh titanium anode turned blue-black. However, the solution which was merely stored did not develop any blue-black color but instead a white precipitate formed which was probably a titanium polymer. It is considered that the precipitation of the iridium-ruthenium complex can be retarded merely by using a higher concentration of hydrochloric acid. In addition, it appears that exposure of the coating solution to the titanium base metal during the coating process accelerates the precipitation of the components of the coating solution. Using a higher concentration of concentrated (37 percent) hydrochloric acid in admixture with 2-propanol as coating solution solvents can decrease the concentration of the cationic ruthenium-iridium complex. However, such an increase in the 37 percent aqueous hydrochloric acid concentration increases the water content of the mixed solvent and this results in hydrolysis of the titanium compound.

EXAMPLES 10–12

Anhydrous hydrochloric acid solutions in 2-propanol were prepared by bubbling gaseous hydrogen chloride into anhydrous 2-propanol. Thereafter, coating solutions were prepared containing 1.73 percent by weight $RuCl_3 \cdot H_2O$ and a mole ratio of 6 percent titanium, 3 percent ruthenium, and 1 percent iridium. Three solutions were prepared having a hydrochloric acid concentration of 1 molar, 2 molar, and 3 molar, respectively (Examples 10, 1, and 12). Half the volume of each solution was used to coat a titanium base mesh to simulate the use of the coating solution to prepare a coated titanium anode. The remaining half of the coating solution was stored in a closed container for a period of up to one year. In all of these solutions neither the ruthenium-iridium complex salt formed nor the titanium precipitate was observed over a period of four to six months. After the six month period, small amounts of the titanium polymer precipitate were observed. With an increased concentration of anhydrous hydrochloric acid, the amount of the titanium polymer precipitate was decreased.

EXAMPLE 13

A coating solution was prepared by dissolving 5.59 weight percent of $H_2IrCl_6 \cdot xH_2O$ and 1.95 weight percent of $Ta(OC_2H_5)_5$ in 2-propanol containing 5 weight percent of anhydrous hydrochloric acid at a concentration of about 1.2 Normal. This solution was used to coat a titanium substrate. After eight months of aging of the solution only a very small amount of precipitate was detected.

EXAMPLE 14

Control, forming no part of this invention

A solution prepared as in Example 13 with the same weight percent of hydrochloric acid obtained by adding a 37 percent aqueous hydrochloric acid solution was observed to immediately form a large amount of a precipitate.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

What is claimed is:

1. A stable solution for coating a surface of a valve metal or alloy thereof base or a surface of a valve metal or alloy thereof surfaced substrate to produce a dimensionally stable anode for use in an electrolytic process, said solution comprising two soluble platinum group metal compounds and a soluble valve metal compound wherein said compounds are solubilized in an anhydrous mixture of an anhydrous, lower, alkyl alcohol and an anhydrous, volatile acid.

2. The solution of claim 1, wherein a soluble valve metal compound is employed therein which is a titanium or tantalum compound and wherein said soluble platinum group metal compounds consist of a ruthenium compound which is thermally-decomposable for forming the electrocatalytic mixed oxide coating to ruthenium oxide and a soluble compound of a second platinum group metal.

3. The solution of claim 2, wherein the second platinum group metal compound is an iridium compound.

4. The solution of claim 3, wherein the lower alkyl alcohol for the anhydrous solvent mixture is selected from the group consisting of methanol, ethanol, 1-propanol, 2-propanol and butanol, and further wherein said volatile acid is selected from the group consisting of hydrochloric acid, hydrobromic acid, acetic acid and formic acid.

5. The solution of claim 4, wherein the lower alkyl alcohol is 2-propanol, a soluble valve metal compound is used which comprises tantalum, and wherein the volatile acid is hydrochloric acid.

6. The solution of claim 2, wherein the lower alkyl alcohol for the anhydrous solvent mixture is selected from the group consisting of methanol, ethanol, 1-propanol, 2-propanol and butanol, and further wherein said volatile acid is selected from the group consisting of hydrochloric acid, hydrobromic acid, acetic acid and formic acid.

7. The solution of claim 6, wherein the lower alkyl alcohol is 2-propanol, a soluble valve metal compound is used which comprises tantalum, and wherein the volatile acid is hydrochloric acid.

8. The solution of claim 1, wherein said platinum group metal compounds are selected from the group consisting of the soluble compounds of iridium, platinum, palladium, rhodium, osmium and ruthenium; said lower alkyl alcohol for said anhydrous solvent mixture is selected from the group consisting of methanol, 1-propanol, 2-propanol and butanol; said volatile acid is selected from the group consisting of hydrochloric acid, hydrobromic acid, acetic acid and formic acid; and said soluble valve metal compound is selected from the group consisting of the soluble compounds of aluminum, zirconium, bismuth, tungsten, niobium, titanium and tantalum.

* * * * *